United States Patent [19]

Ingvaldsen

[11] 4,017,981

[45] Apr. 19, 1977

[54] PROCESS FOR DRYING YOUNG GRASS AND SIMILAR PRODUCTS AND AN APPARATUS FOR CARRYING OUT THE PROCESS

[76] Inventor: Bernt Ingvaldsen, Solbakken 43, N-3000 Drammen, Norway

[22] Filed: Sept. 15, 1975

[21] Appl. No.: 613,458

Related U.S. Application Data

[63] Continuation of Ser. No. 451,793, March 18, 1974, abandoned.

[30] Foreign Application Priority Data

Mar. 23, 1973 Norway ..... 731199

[52] U.S. Cl. ..... 34/26; 34/30; 34/38

[51] Int. Cl.[2] ..... F26B 3/06

[58] Field of Search ..... 34/22, 26, 38, 30, DIG. 12, 34/DIG. 15, 233

[56] References Cited

UNITED STATES PATENTS

| | | | |
|---|---|---|---|
| 1,194,351 | 8/1916 | Benjamin | 34/26 X |
| 2,532,530 | 12/1950 | Andersen et al. | 34/233 |
| 2,613,452 | 10/1952 | Andersen et al. | 34/233 X |
| 3,380,174 | 4/1968 | McClaren | 34/26 |
| 3,417,487 | 12/1968 | Harris | 34/233 |
| 3,449,840 | 6/1969 | Francis | 34/236 X |

FOREIGN PATENTS OR APPLICATIONS

| | | | |
|---|---|---|---|
| 447,204 | 5/1936 | United Kingdom | 34/22 |

*Primary Examiner*—William F. O'Dea
*Assistant Examiner*—Harold Joyce
*Attorney, Agent, or Firm*—Arthur C. Johnson

[57] ABSTRACT

Young grass having a moisture content of about 80% is dried in layers by forcing a stream of air through the layer. The thickness of the layer and the conditions of the drying air are adjusted so that when most of the grass in the layer is sufficiently dry (about 12% moisture), there will still be present an outer layer which is by far not dry (moisture content of about 65%). Thereby, the drying air emerging from the layer will have a humidity of approximately 100%, meaning that the drying capacity of the air has been exhausted. When the humidity of the drying air emerging from the layer falls substantially below 100%, the major part of the grass will have been dried to the desired dryness (about 12% moisture). It is then not economical to continue the drying process, which is consequently interrupted, the not yet dry minor part (outer layer) of the grass being transferred for drying together with further green grass in another drying process. Each process is carried out with non-heated atmospheric air from the beginning, but towards the end of the process, air of reduced relative humidity obtained by slightly heating atmospheric air must be used to reduce the moisture content in most of the grass to 12% before the moisture content in the outer layer goes below 65%. A simple, portable drying plant for carrying out the process in the field is also provided. The degree of heating and the beginning of the heated air drying can be varied, and the combination giving the best economy is determined by operational and local conditions, such as the number of drying plants operated together, the source of energy available etc.

2 Claims, 2 Drawing Figures

PROCESS FOR DRYING YOUNG GRASS AND SIMILAR PRODUCTS AND AN APPARATUS FOR CARRYING OUT THE PROCESS

This is a continuation, of application Ser. No. 451,793, filed Mar. 18, 1974, abandoned.

BACKGROUND OF THE INVENTION

The present invention relates to a process for drying young grass, green fodder, seaweed and similar products having a high moisture content by forcing as far as possible uniformly distributed air through a stationary, relatively thick bed of the goods to be dried, while using first non-heated air and towards the end of the drying period air that has been heated to reduce its relative humidity to 35% or less. The invention also relates to an apparatus for carrying out such a process, said apparatus comprising a grid surface or the like on which the goods to be dried are placed, and a blower forcing possibly heated air up through the grid surface and through the grass.

It has long been known that by artificially drying young grass a valuable fodder which may substitute all kinds of concentrates for domestic animals, especially cattle and sheep, can be produced. Firstly, young grass has a high content of various types of proteins in digestible form and having a favorable distribution between the types thereof. At the same time, the content of vitamins and provitamins, especially carotene, is of importance. When the drying process is such that the natural content of protein and carotene in the grass is maintained, a feeding on dried grass will keep the animals in good shape.

Fodder from young grass may be of particular importance in Norway where the climate is favourable for the production of grass, with respect to both precipitation, temperature and light conditions. The production of dried grass can therefore give a larger yield per unit area than other crops of fodder products. This is also due to the fact that when the precipitation is suitable, a more abundant manuring is possible if the grass is cut several times during the season.

Drying of young grass entails advantages compared with ensilaging of the grass. Thus, the concentration of the fodder is higher and fermentation is avoided. In addition, the use of acid and the pollution due to the silage juice is eliminated. Further, ensilage should be avoided when the milk is to be used for making high quality cheese. However, when using dried grass, the resulting milk is very well suited for producing butter and high quality cheese.

In spite of the above strong motives for the use of dried grass, the drying of young grass has hitherto not become common practice. This is due to the difficulties attached to the provision of a rational and economic drying of the grass at a rate which is suitable in farming. Young grass consists of relatively large amounts of leaves and small amounts of stems as compared with fully grown grass (hay). The dried grass bed will therefore become relatively dense, and fermentation and putrifiction very often occur upon storing. To keep its quality the dried young grass must, therefore, be dried down to a moisture content of approximately 12%, whereas in hay a moisture content of up to 20% is acceptable, especially if airily stored. Regard being had to the fact that the newly cut, young grass has a very high moisture content of approximately 80% of its weight, relatively much water has to be removed by the drying. In addition, the grass is so short that it is not easily framed in the same way as hay. Drying is therefore usually carried out by means of heat in apparatus which are rather expensive, complicated and/or labour consuming, and in which i.a. the transportation of the raw grass plays an important role. A plurality of various drying apparatus are known, such as drum driers, belt driers, shuffle driers etc. usually involving a movement of the goods to be dried. The heat consumption is rather high, often from 1000 calories or more per kg evaporated water, corresponding to approximately 4 kWh per kg finished dried grass. Such an energy consumption prevents an economic production of dried grass.

As the drying air is passed through the goods to be dried it gradually cools and absorbs moisture. After having passed through a drying zone which is usually 20 to 30 cm, the drying air will have such a high humidity that it is no longer capable of absorbing moisture from the grass. The end of this drying zone may be called the drying front. As long as the moisture content in the grass is above approximately 65%, the drying air becomes saturated with moisture and the drying front lies within the grass bed. At first, only the inner zone of 20 to 30 cm of the grass will be dried. As the moisture content in this zone is reduced, the drying front will gradually advance through the goods to be dried.

A drying process comprising a preliminary drying by means of non-heated or only slightly heated air followed by a final drying with a stream of somewhat heated air gives a better economy than drying with heated air from the beginning. This is due to the fact that the reduction of the relative humidity of the drying air by heating is not necessary as long as the humidity of the outdoor air is not substantially above 70% and the water content of the grass is relatively high. However, experience has shown that when the moisture content in the grass at the end of the drying process becomes relatively low, drying air with a relative humidity of 30 to 35% must be used to permit the water content in the grass to be reduced to approximately 12% during a reasonable span of time. This reduction of the relative humidity of the air is suitably obtained by a certain heating of the air. In order to avoid the requirement of too large heating units, the rate of air through the grass can be reduced.

In the publicly available Norwegian patent specification No. 135 644 it has been suggested an apparatus for drying young grass in several steps while using a plurality of stationary sections. This apparatus consisted of a ventilated storage place in the form of one or several covered bins for preliminary drying with unheated air. Thereafter, the grass was to be transferred to a drying apparatus with circulating heated air for completing the drying, so that the storage place could once more be filled with a new lot of newly mown grass. This is then subjected to a preliminary drying at the same time as the drying of the first lot of grass is completed in the drying apparatus. Such a process requires relatively much labour due to the transfer of all the grass. The apparatus is relatively large and expensive.

It has also been suggested (see NO-PS 108 897) to dry young grass in "drying sheds" having a grid-formed sloping floor through which drying air is passed by means of a blower at the rear side of the "shed". Such a drying shed is relatively simple and labour-saving. It is, however, still a stationary apparatus.

In the abovementioned apparatus it has further proved difficult to avoid that the drying air will find its way along the walls of the drying room rather than being distributed through the goods to be dried. In addition, the heating economy is still not satisfactory.

SUMMARY OF THE INVENTION

Thus, the object of the present invention is to provide a process which is substantially more economic than known processes, the energy consumption per kg dried grass being limited to approximately 2 kWh or less, which process can be carried out in an apparatus which is simpler and cheaper than known apparatus. Further, there is to be provided such an apparatus which can easily be disassembled and moved to another place, when required, to be used at different places on a farm, or possibly, sequentially on several farms.

The process according to the invention is characterized by adjusting the thickness of the bed and the drying conditions such that the drying of the major part of the goods is completed when the drying front has advanced through the bed and the humidity of the drying air emerging therefrom is substantially lower than 100%, and then interrupting the drying process and removing the not yet dried layer for drying in another drying process.

In this way it is ensured that the drying capacity of the air is utilized to the best possible extent, the grass bed at any time comprising an outer layer having a relatively high moisture content. This is especially important during the last part of the drying, when air is used into which much energy in the form of heat has been incorporated, which air is, therefore, costly. By the process according to the invention the used drying air will have such a high moisture content that it should not be recirculated.

According to another feature of the invention two or more beds are dried simultaneously with such a phase displacement that the total consumed power for drying the beds is approximately constant. By such a combined operation of two or more apparatus an effective utilization of a common heating unit or an economic tapping from the mains is achieved without necessitating reloading of all the grass.

The apparatus according to the invention is characterized by an air conduit which, from an air inlet opening lying substantially above the ground and facing away from the surface for the grass, leads down to the ground and horizontally along the ground to an air outlet, the grid surface for the grass comprising sloping surfaces extending all the way down to the ground and defining an air distribution chamber around the air outlet. The portion of the conduit extending along the ground may be let into the ground, if desired.

The air passage may be divided into smaller sections in order to facilitate the moving of the apparatus. Further, the grid surface may be divided into smaller sections which can be assembled into a self-contained hood or box over the air outlet. The advantage of having an air inlet lying substantially above the ground resides in that it is avoided to suck in the air next to the ground, which air is often more humid than the air above. Especially the risk of recirculation of used drying air is reduced, since the non-heated air passed through the goods and having a relatively high moisture content will have a lower temperature than the ambient air and will, therefore, sink towards the ground.

In consequence of the grid surfaces extending all the way down to the ground and resting thereon, the grass placed on the grid suface in the form of a suitable bed of a thickness of e.g. 1 to 1.5 m also contacts the ground around the grid surface and provides an adequate sealing in this place so as to avoid short-circuiting of the drying air, instead actually distributing the air through the goods.

The apparatus can also comprise a fence outside the place of contact of the sloping surfaces with the ground in order to provide a confinement of the goods and facilitate the accomplishment of a suitable shape and thickness thereof.

The blower can preferably be positioned at the outlet end of the air conduit, thus being located below the grid surface and in operation being surrounded by grass. This entails partly a substantial reduction of the noise from the apparatus and partly an effective utilization of the heat from the blower motor.

The invention will now be further described, reference being had to the accompanying drawings.

DETAILED DESCRIPTION OF PREFERRED EMBODIMENTS

Figure 1:
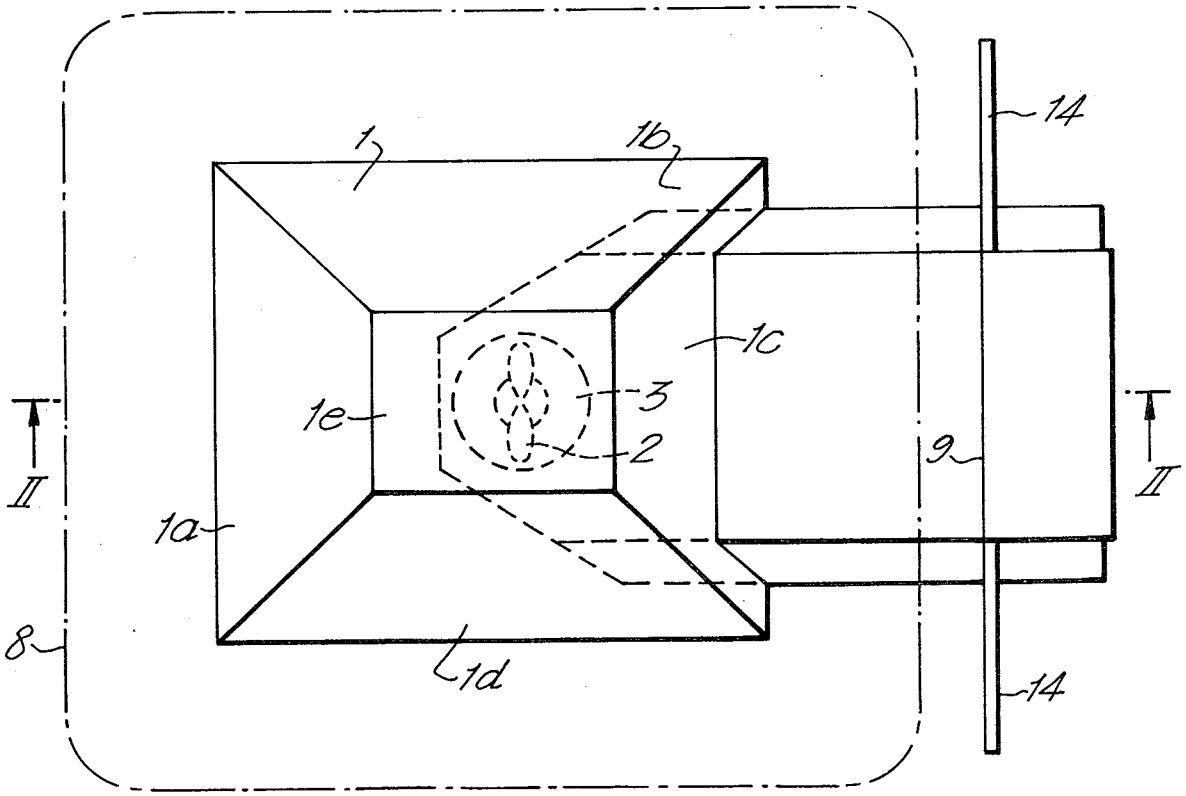
FIG. 1 very schematically shows a top view of an apparatus according to the invention.
Figure 2:
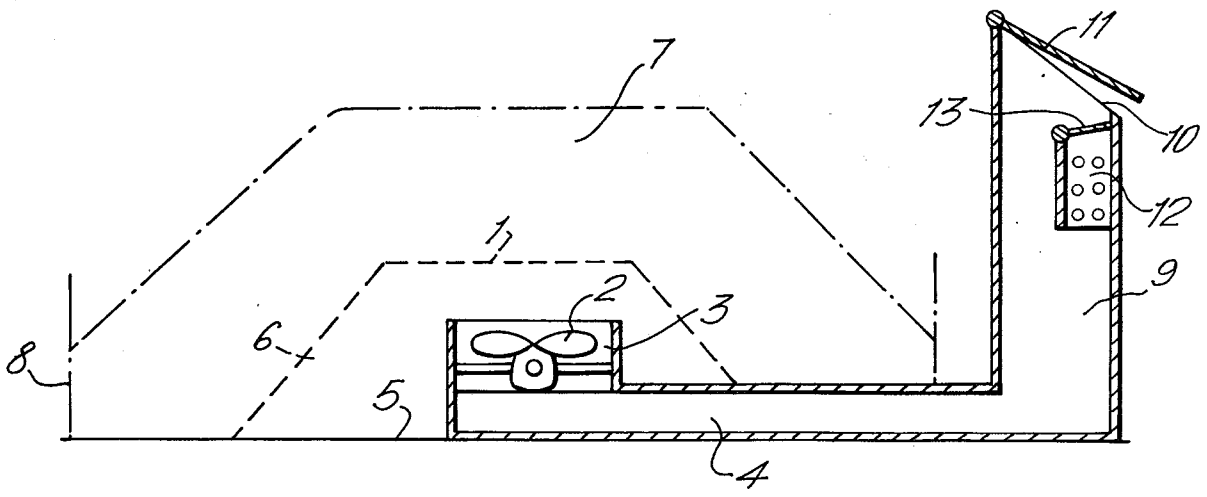
FIG. 2 is a sectional view along the line II—II in FIG. 1.

As shown in the drawing the apparatus consists of a grid surface 1 taking the form of a truncated pyramide which has been placed over a blower 2 arranged in an outlet 3 from a conduit 4. The blower may, if desired, be arranged somewhat upstream of the outlet 3. The conduit 4 as well as the grid surface 1 rest on a support 5 which may be constituted simply by the ground. The grid surface 1 is divided into sections, e.g. four trapeziform sloping surfaces 1*a* to 1*d* and a rectangular top surface 1*e*. The sections may, for instance, be made up of iron gates covered with netting to provide a large throughput area for the air. The sections may bear against each other and together form a self-contained hood or box defining a distribution chamber 6 around the air outlet 3, which may be given any shape adapted to ensure an appropriate distribution of the air in the distribution chamber. In FIG. 2, the goods to be dried are indicated by 7. It will afford a good sealing against the ground 5 due to its weight. To avoid the formation of fissures in the grass bed at the upper end of the sloping surfaces 1*a* to 1*d*, the inclination of these sloping surfaces should be so slight and the surfaces should provide such a large friction against the movement of the grass, that the latter will not sag down along the sloping surfaces.

In order to facilitate the provision of a suitable distribution and thickness of the grass bed 7, an enclosure 8 is arranged around the distribution chamber 6, said enclosure consisting e.g. of rigid gate sections or taking the form of a coilable netting fence.

For supplying air to the blower 2 the conduit 4 extends along the ground 5 till outside the grass bed 7, where the conduit 4 emerges into a vertical air inlet conduit 9 with an inlet opening 10 controlled by a damper 11. In the conduit 9 there is provided a heating unit 12, and a control damper 13 directs the air either through or around the heating unit. The inlet opening 10 faces away from the grid surface 1 and lies, as shown, at a level substantially above the ground 5. In connection with the conduit 9 there may be provided walls 14 for further shielding the inlet opening 10 from the air emerging from the grass bed 7.

In the application of the apparatus according to the invention the air conduits and possibly the walls 14 are assembled on the ground in a place permitting connection to the mains. If desired, the conduit 4 can be let into a channel in the ground. Thereupon, the grid surface 1 is assembled over and around the blower 2 as shown in the drawing. For the ambient air used for the drying process to be as dry as possible, the drying apparatus should not be placed in the shadow. As the air is often cooler and more humid in the vicinity of trees an ample distance therefrom should be maintained.

Young newly mown grass is placed on the grid surface 1 to a thickness of 1 to 1.5 m. The grass is placed so that the air resistance becomes substantially uniform in all directions and the sealing pressure against the ground or the support becomes sufficient.

Because the blower motor is positioned under the grid surface 1 the heat dissipation from the motor and the blower is most effectively utilized, and at the same time the sound of the blower which may be very unpleasant, is practically eliminated. The air conduit 4 is designed to be wide and low so that an adequate quantity of grass is obtained above the conduit to afford the desired sealing. As mentioned above, the air conduit can be let into the ground, if desired. The upper side of the conduit 4 may have transverse ribs or may otherwise be roughened to minimize the air leakage along the outer surfaces of the air conduit.

The air which is blown through the grass, is cooled during the drying process, and when heated air is used, the air emerging from the grass bed 7, becomes colder and more humid than the ambient air. Therefore, the air tends to sink down to the ground. The shown arrangement of the air inlet opening 10 largely prevents this air from reentering the process.

As the air advances from the air distribution chamber through the grass bed, it cools and absorbs moisture. After having passed through a drying zone which usually has a length of 20 to 30 cm, the drying air will have such a high moisture content that it can no more absorb moisture from the grass. As long as the moisture content in the grass is above approximately 65%, the drying air becomes substantially saturated with moisture. In the beginning, only the inner layer of 20 to 30 cm of the grass will be dried. As the moisture content in this layer is gradually reduced, the drying zone will advance through the grass bed.

Air having a temperature of 15° C and a relative humidity of 70% can theoretically dry the grass to a water content of approximately 27%. To have the grass dried to a water content of approximately 12% air of a relative humidity of below 42% must be used. In practice, the relative humidity should be at 35 to 30%, which may be achieved by heating ambient air having a temperature of 15° C and a humidity of 70% to 27° to 30° C.

The larger part of the water in the grass may be removed by means of non-heated air. As stated, such air can theoretically dry the grass to a water content of approximately 27% corresponding to approximately 7.5 kg remaining water, if the initial water content was aproximately 80 kg (100 kg green grass). Thus, 72.5 kg water has been removed. When the humidity is 12%, 2.7 kg of the original water is present, meaning that theoretically merely approximately 4.8 kg water has to be removed by means of heated air.

To establish a reasonable length of the drying period and to prevent the drying front from prematurely emerging from the bed, the drying with heated air must commence before the water content is reduced to 27%. Cold air having a temperature of 15° C and a moisture content of 70% may, for instance, be used for 36 hours, whereupon a blowing for 8 hours with air heated by 3° C (58% humidity) and 10 hours with air heated by 15° C (30% humidity) is effected. This means that heated air is used for one third of the time of operation. Three apparatus according to the invention can accordingly be used, said apparatus being operated with a phase displacement so that only one apparatus at a time operates with heated air. So long as the drying front has not reached the outer surface of the goods to be dried, which is accordingly sufficiently humid, the drying capacity of the heated air is fully utilized. The drying apparatus is preferably arranged outdoors in the vicinity of the mowing meadow. Shorter rain-falls play a minor role for the drying process, as the rain-water does not penetrate far into the grass bed, but flows off or remain in the outermost, humid layer of grass.

The slight heating of the drying air permits the blower to be located inside the drying system. The heat evolved by the blower motor is thereby utilized in the heating of the drying air, the noise from the blower being also reduced to a minimum.

When the inclination of the sloping grid surfaces 1*a* to 1*d* are relatively slight, there can be obtained a relatively uniform air distribution in all directions as well as an effective sealing, so that the drying air must pass through the goods, thereby being effectively utilized.

In addition to the abovementioned advantages the positioning of the air inlet at a relatively high level above the ground entails that a covering of the heating elements 12 is safely avoided, so that the fire hazard is reduced.

If electric heating is used, the operation of e.g. three apparatus with phase displacement provides an even load on the mains. If other forms of heating are used, e.g. an apparatus for drying buildings, this apparatus may be used sequentially for the three apparatus. Thereby, the economy is favoured without having to reload the goods to be dried. The natural drying capacity of the cold air is at all times utilized to the full extent.

What I claim is:

1. A process for drying goods such as young grass, green fodder, seaweed and similar products having a high moisture content of about 80% by forcing uniformly distributed air through a stationary bed of at least 1 m of the goods to be dried, said air absorbing moisture from the goods in a drying front of 20 to 30 cm, at the forward end of which the air is substantially saturated with moisture and produces no further drying, said drying front advancing through the bed as the goods are dried, while using towards the end of the drying process drying air that has been slightly heated to reduce its relative humidity to 35% or less such that the drying of the major part of the goods is completed when the drying front has advanced to the outer surface of the bed, to provide a major inner layer of completely dried goods of about 12% moisture content and an outer minor layer of a thickness of about ¼ to ⅛ the total thickness of the bed but not exceeding 30 cm and having an increasing moisture content of up to approximately 65% and with the humidity of the air emerging from the bed still approximating 100%, and then terminating the drying process and removing the minor layer for drying in another drying process and the major layer as a finished product.

2. A process as claimed in claim 1, characterized in that two or more beds are dried simultaneously with such a phase displacement that the total consumed power for drying the beds is approximately constant.

* * * * *